US009353701B2

(12) United States Patent
Yamamoto

(10) Patent No.: US 9,353,701 B2
(45) Date of Patent: May 31, 2016

(54) CYLINDER BLOCK AND MANUFACTURING METHOD THEREOF

(75) Inventor: Toshiaki Yamamoto, Toyota (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 123 days.

(21) Appl. No.: 14/002,603

(22) PCT Filed: Feb. 17, 2012

(86) PCT No.: PCT/IB2012/000289
§ 371 (c)(1),
(2), (4) Date: Aug. 30, 2013

(87) PCT Pub. No.: WO2012/120345
PCT Pub. Date: Sep. 13, 2012

(65) Prior Publication Data

US 2013/0333658 A1 Dec. 19, 2013

(30) Foreign Application Priority Data

Mar. 9, 2011 (JP) ..... 2011-051793

(51) Int. Cl.
*F02F 1/14* (2006.01)
*F02B 75/18* (2006.01)
(Continued)

(52) U.S. Cl.
CPC ... *F02F 7/00* (2013.01); *F02F 1/10* (2013.01); *F02F 1/14* (2013.01); *F01C 21/06* (2013.01); *F01P 2003/021* (2013.01); *Y10T 29/49231* (2015.01)

(58) Field of Classification Search
CPC ..... F01P 3/20; F01P 11/04; F01P 11/06; F01P 3/02; F02F 1/10; F02F 1/14; F02F 1/16; F02B 3/06
USPC ..... 123/41.01, 41.67, 41.68, 41.72, 41.74, 123/41.79
See application file for complete search history.

(56) References Cited

U.S. PATENT DOCUMENTS 3,363,608 A * 1/1968 Scherenberg ..... F01P 3/02 123/193.3
7,322,320 B2 * 1/2008 Sugano ..... F02F 1/36 123/41.72

(Continued)

FOREIGN PATENT DOCUMENTS

CN 201334962 Y 10/2009
JP 63-198449 U 12/1988

(Continued)

OTHER PUBLICATIONS

Partial Translation of Japanese Office Action dated Aug. 26, 2014, issued in counterpart Japanese application No. 2011-051793.

*Primary Examiner* — Stephen K Cronin
*Assistant Examiner* — Syed O Hasan
(74) *Attorney, Agent, or Firm* — Sughrue Mion, PLLC

(57) ABSTRACT

A cylinder block (100) of the invention includes a coolant passage (115) that guides coolant inside of a water jacket (120), inside of an inter-bore partition wall (111). The coolant passage (115) is formed by a head-side drill hole (115*a*) that opens at a position away from a center portion of a top surface of the inter-bore partition wall (111) and is formed inclined with respect to an extending direction (L2) of an axis of a cylinder bore so as to come closer to the center portion of the inter-bore partition wall (111) farther away from the top surface, and a jacket-side drill hole (115*b*) that is communicated with a tip end portion of the head-side drill hole (115*a*) and opens into the water jacket (120) and is formed inclined with respect to the extending direction (L2) of the axis toward the opening so as to gradually come closer to the top surface.

9 Claims, 3 Drawing Sheets

(51) Int. Cl.

| | |
|---|---|
| ***F01P 9/00*** | (2006.01) |
| ***F02F 7/00*** | (2006.01) |
| ***F02F 1/10*** | (2006.01) |
| *F01C 21/06* | (2006.01) |
| *F01P 3/02* | (2006.01) |

(56) References Cited

U.S. PATENT DOCUMENTS

2002/0100435 A1* 8/2002 Osman ..... F02F 1/14
123/41.72
2002/0121250 A1* 9/2002 Shimizu ..... F02F 1/108
123/41.28
2010/0319637 A1* 12/2010 Ito ..... F02F 1/36
123/41.01
2011/0030627 A1 2/2011 Bing et al.

FOREIGN PATENT DOCUMENTS

| | | | |
|---|---|---|---|
| JP | 09-151784 | A | 6/1997 |
| JP | 2002-227716 | A | 8/2002 |
| JP | 2010-038033 | A | 2/2010 |
| JP | 2010-150989 | A | 7/2010 |
| JP | 2010-537115 | A | 12/2010 |

* cited by examiner

CYLINDER BLOCK AND MANUFACTURING METHOD THEREOF

BACKGROUND OF THE INVENTION

1. Field of the Invention

The invention relates to cylinder block provided with a coolant passage inside of an inter-bore partition wall that is positioned between adjacent cylinder bores, and to a manufacturing method of the cylinder block.

2. Description of Related Art

An inter-bore partition wall that is positioned sandwiched between cylinder bores that form combustion chambers is easily affected by combustion heat, and thus tends to reach a high temperature as an engine operates. Therefore, a cylinder block in which a coolant passage for guiding some coolant in a water jacket is provided inside the inter-bore partition wall is known.

In order to reduce the weight and size of an engine, it is preferable that each portion of the cylinder block be thin, and that the inter-bore partition walls also be as thin as possible. The center portion of the inter-bore partition wall where adjacent cylinder bores are closest is a portion where cooling is particularly important. However, the inter-bore partition wall is thin, so if a coolant passage that enables coolant to pass through this center portion is formed, strength is no longer able to be ensured. Therefore, if the inter-bore partition wall is made thin in order to reduce the weight and size of the cylinder block, a coolant passage that passes through the center portion of the inter-bore partition wall may not be able to be provided.

Therefore, a cylinder block described in Japanese Patent Application Publication No. 9-151784 (JP-A-9-151784) is provided with a coolant passage that is curved by joining an upper passage that extends away from the center portion toward a cylinder head side with a lower passage that extends away from the center portion toward a crankcase side, with the upper end of the lower passage being communicated with the lower end of the upper passage. Coolant in the water jacket is guided near the center portion of the inter-bore partition wall by this curved coolant passage.

Employing this structure makes it possible to guide coolant near the center portion without forming a coolant passage that passes through the center portion of the inter-bore partition wall, so the center portion of the partition wall is able to be cooled while still ensuring the strength.

With the cylinder block described in JP-A-9-151784, the upper passage is formed by drilling a hole at an angle from a portion on the cylinder head side inside the water jacket toward the center portion side of the inter-bore partition wall. Meanwhile, the lower passage that communicates the water jacket with the upper passage is formed by drilling a hole through the water jacket from inside the crankcase toward the cylinder head side. After the lower passage is formed in this, way, the unwanted through-hole that remains on the crankcase side is blocked off (see paragraph [0014] and FIG. 6 in JP-A-9-151784).

With the cylinder block described in JP-A-9-151784, an unwanted through-hole is formed in the process of forming the coolant passage, so a process to block off this unwanted through-hole is required.

Also, the coolant passage described in JP-A-9-151784 communicates the upper and the lower portions of the water jacket through the inside of the partition wall, and circulates coolant from down to up using natural convection that increases as the temperature of the coolant in the coolant passage rises (see paragraph [0017] in JP-A-9-151784).

Therefore, with the cylinder block described in JP-A-9-151784, even if a flow is generated in the coolant inside of the Water jacket, a flow is not easily generated in the coolant inside the coolant passage, and thus coolant inside the coolant passage does not readily circulate.

SUMMARY OF THE INVENTION

This invention thus provides a cylinder block provided with a coolant passage that can be formed without requiring a process of blocking off an unwanted hole after machining, and that is able to rapidly circulate coolant, and provides a manufacturing method of the cylinder block.

A first aspect of the present invention relates to a cylinder block provided with a water jacket formed surrounding a plurality of cylinder bores, and a coolant passage that is inside of an inter-bore partition wall positioned between adjacent cylinder bores and that guides coolant inside of the water jacket without passing through a center portion that is a thinnest portion of the inter-bore partition wall. The coolant passage is formed by i) a head-side hole that opens at a position away from a center portion of a top surface on a cylinder head side of the inter-bore partition wall and is formed inclined with respect to an axial direction of the cylinder bore so as to come closer to the center portion farther away from the top surface, and ii) a jacket-side hole that is communicated with a tip end portion of the head-side hole and opens into the water jacket and is formed inclined with respect to the axial direction from a portion that is communicated with the head-side hole toward the opening so as to gradually come closer to the top surface.

According to this aspect, the jacket-side hole as well as the head-side hole is also inclined from the cylinder head side toward the crankcase side so as to gradually come closer to the center portion. Therefore, the head-side hole can be formed entering from the top surface of the inter-bore partition wall, while the jacket-side hole can be formed entering from the opening of the water jacket of the cylinder block upper portion. Therefore, there is no need for a process to block off an unwanted through-hole after machining a typical cylinder block that involves forming a lower passage through the water jacket from the crankcase side. That is, according to the structure described above, the coolant passage can be formed without requiring a process of blocking off an unwanted through-hole after machining.

Also, the coolant passage is open to the water jacket and the top surface of the inter-bore partition wall that is connected to the cylinder head, so this coolant passage serves as a passage for circulating coolant between the water jacket on the cylinder head side and the water jacket formed inside of the cylinder block. Therefore, a flow corresponding to the pressure difference between the coolant inside the water jacket on the cylinder head side and the coolant inside the water jacket on the cylinder block side is generated in the coolant inside of this coolant passage, so coolant inside the coolant passage circulates quickly. Thus, a greater cooling effect than that obtained by the related water jacket that circulates coolant by natural convection is able to be obtained.

That is, according to the structure described above, a cylinder block provided with a coolant passage that can be formed without requiring a process of blocking off an unwanted through-hole after machining and that is able to quickly circulate coolant, is able to be realized.

A portion near the top surface of the cylinder block that is connected to the cylinder head, in particular, a portion from the top surface of the inter-bore partition wall to the height of the top ring when the piston is at TDC, is exposed to high-temperature, high-pressure combustion gases while the engine is operating. Therefore, this portion in particular must be intensively cooled.

In order to intensively cool this portion, the depth of the portion that communicates the head-side hole with the jacket-side hole may be set based on the height of the top ring when the piston is at top dead center.

With the coolant passage in the cylinder block, the portion where the head-side hole is connected to the jacket-side hole is a portion that is farthest away from the top surface of the inter-bore partition wall. Therefore, if the structure described in the aspect described above is employed, coolant can be intensively circulated to the portion that is higher than the top ring, while circulating as little coolant as possible to the portion lower than the position of the height of the top ring when the piston is at top dead center. As a result, coolant is inhibited from being circulated in an area wider than necessary, and thus is inhibited from increasing in temperature, so the portion from the top surface of the inter-bore partition wall to the height of the top ring when the piston is at top dead center that needs to be intensively cooled is able to be efficiently cooled.

If the coolant passage is too close to the center portion that is the thinnest portion of the inter-bore partition wall, the strength of the inter-bore partition wall is unable to be ensured. Also, in many engines, the inner peripheral surface of the cylinder bore is formed by a cylinder liner of a different material than the cylinder block main body. Therefore, more specifically, the tip end portion of the head-side hole may be located such that the tip end portion of the head-side hole does not interfere with a cylinder liner that forms an inner peripheral surface of the cylinder bore.

Employing this structure makes it possible to inhibit the coolant passage from interfering with the cylinder liner, and the coolant passage can be appropriately distanced from the center portion. When the cylinder head is mounted to the cylinder block, A head gasket is sandwiched between the top surface of the cylinder block and the bottom surface of the cylinder head. Also, a seal portion such as a bead formed on the head gasket abuts against the peripheral edge portion of the cylinder bore of the top surface of the cylinder block, and the contact pressure therefrom provides a seal against combustion gases.

Here, if the opening of the head-side hole formed in the top surface of the inter-bore partition wall is formed in a position overlapping with the seal portion of the head gasket, the area of the seal surface decreases by the amount of the portion that overlaps with the opening, so an appropriate seal may not be able to be ensured.

Therefore, when setting the position of the opening of the head-side hole, a shortest length between the opening of the head-side hole in the top surface of the inter-bore partition wall and the cylinder bore may be set such that the opening does not overlap with the seal portion of the head gasket.

Employing this kind of structure makes it possible to appropriately distance the position of the opening from the seal portion and thereby inhibit the area of the seal surface from decreasing, which in turn makes it possible to ensure an appropriate seal.

If the angle formed by the head-side hole and the jacket-side hole that intersect inside the inter-bore partition wall and together form the coolant passage is reduced, the direction of the coolant that flows through the coolant passage greatly changes at the portion where the head-side hole connects with the jacket-side hole. Therefore, coolant will strike the wall surface of the coolant passage at this portion hard, creating turbulence. As a result, the coolant flowing through the center of the coolant passage and the coolant flowing near the wall surface of the coolant passage are agitated, such that the effect of heat exchange performed via the wall surface of the coolant passage further increases.

Therefore, in order to improve heat exchange efficiency, the angle between the head-side hole and the jacket-side hole that intersect inside the inter-bore partition wall and together form the coolant passage may be reduced. Thus, the angle between the head-side hole and the jacket-side hole may be an acute angle.

By employing this kind of structure, coolant strikes the wall surface of the coolant passage hard at the portion where the head-side hole connects with the jacket-side hole, such that turbulence is generated inside the coolant passage, which enables the heat exchange efficiency to be increased.

In order to efficiently cool the inter-bore partition wall, a plurality of the coolant passages may be provided in an area that enables the strength of the inter-bore partition wall to be ensured. For example, a pair of the coolant passages may be formed in the inter-bore partition wall so as to sandwich the center portion of the inter-bore partition wall.

Employing this kind of structure makes it possible to increase the cooling effect more so than with a structure in which only one coolant passage is provided, as well as makes it possible to more evenly cool the entire inter-bore partition wall due to the fact that both of the portions positioned on both sides of a center portion of the inter-bore partition wall are able to be cooled.

In the above aspect, the two coolant passages may be provided axisymmetrical about the center portion inside the inter-bore partition wall.

In the above aspect, an inclination of an extension line of the jacket-side hole that extends to outside of the water jacket may be set such that the extension line does not contact a head bolt boss that forms an outer peripheral side end portion of the water jacket.

In the above aspect, the head-side hole and the jacket-side hole may both be holes that are in straight lines.

A second aspect of the present invention relates to a manufacturing method of a cylinder block provided with a water jacket formed surrounding a plurality of cylinder bores, and a coolant passage that is inside of an inter-bore partition wall positioned between adjacent cylinder bores and that guides coolant inside of the water jacket without passing through a center portion that is a thinnest portion of the inter-bore partition wall. The manufacturing method includes: forming a head-side hole at an angle inclined with respect to an axial direction of the cylinder bore so as to come closer to the center portion farther away from a top surface on a cylinder head side of the inter-bore partition wall, from a position away from a center portion of the top surface; and forming a jacket-side hole at an angle inclined with respect to the axial direction from a wall surface of the inter-bore partition wall that faces the water jacket toward a tip end of the head-side hole so as to gradually come closer to the top surface, and communicating the head-side hole with the jacket-side hole.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
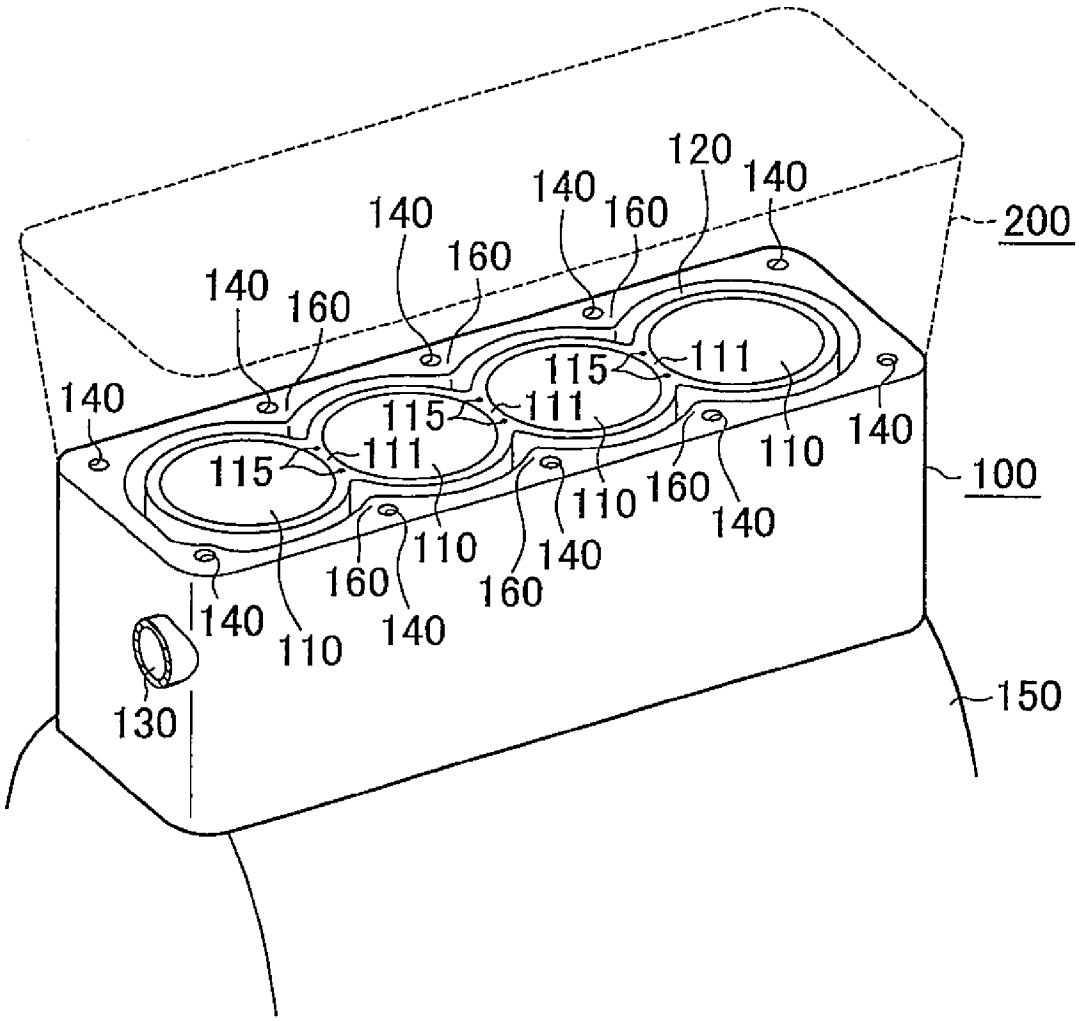
FIG. 1 is a perspective view of a cylinder block according to an example embodiment of the invention.

Hereinafter, an example embodiment in which a cylinder block of the invention is described as a cylinder block 100 of an inline four cylinder engine will be described with reference to FIGS. 1 to 3. As shown in FIG. 1, cylindrical cylinder bores 110 that form combustion chambers are formed in an upper portion of the cylinder block 100. Four of these cylinder bores 110 are formed in a line. In addition, a water jacket 120 that surrounds these four cylinder bores 110 is also formed in the cylinder block 100.

Also, a coolant inlet 130 that guides coolant discharged from a water pump into the water jacket 120 is formed in a side surface of the cylinder block 100. A plurality of bolt holes 140 are formed in a top surface of the cylinder block 100. Therefore, by inserting and screwing head bolts into these bolt holes 140 when a cylinder head 200 is mounted to the cylinder block 100, as shown by the broken line in FIG. 1, the upper surfaces of the cylinder bores 110 become blocked off by the cylinder head 200, such that the combustion chambers are formed.

A skirt portion 150 that forms a crankcase in which a crankshaft is housed is provided below the cylinder block 100. In each inter-bore partition wall 111 positioned between adjacent cylinder bores 110 of the cylinder block 100 are provided two coolant passages 115 that open to the top surface of the inter-bore partition wall 111, as shown in FIG. 1.

Hereinafter, these coolant passages 115 will be described in detail with reference to FIGS. 2 and 3. Also, to simplify the description, portions will be described in the singular form when possible. As shown in FIG. 2, a portion the inter-bore partition wall 111 through which the alternate long and short dash line L1 that connects the center lines of the cylinder bores 110 together passes, i.e., the center portion of the inter-bore partition wall 111, is the thinnest. The coolant passages 115 are formed, one on both sides of the center portion of the inter-bore partition wall 111, so as to guide the coolant inside of the water jacket 120, in the inter-bore partition wall 111, without passing through the center portion. As shown in FIGS. 2 and 3, the coolant passages 115 positioned on both sides of the center portion of the inter-bore partition wall 111 are bilaterally symmetrical in shape, so in the description below, only the coolant passage 115 on the right side in FIGS. 2 and 3 will be described. A detailed description of the coolant passage 115 on the left side in FIGS. 2 and 3 will be omitted.

Figure 2:
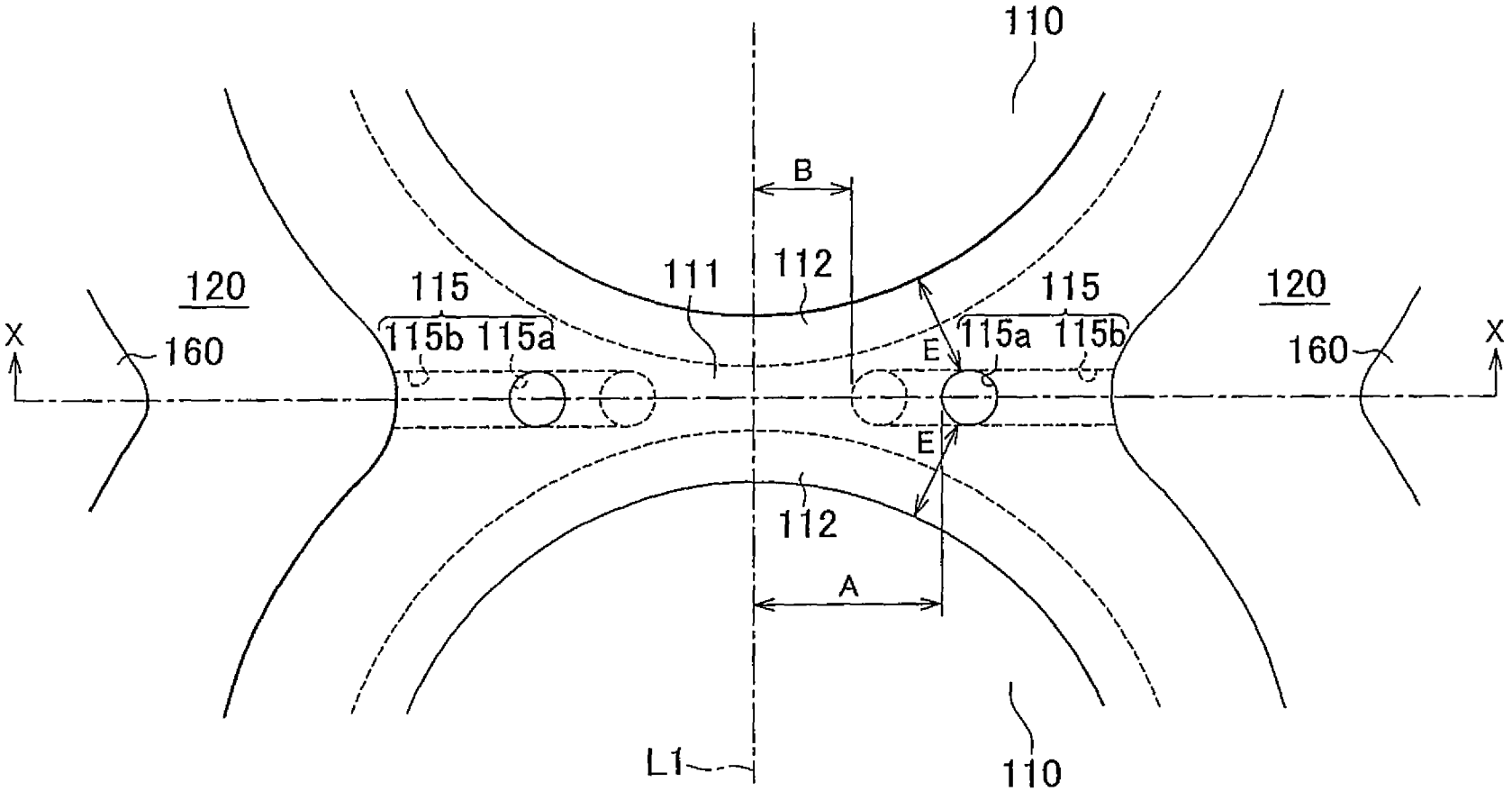
FIG. 2 is an enlarged plan view of a portion near an inter-bore partition wall of the cylinder block according to the example embodiment.
Figure 3:
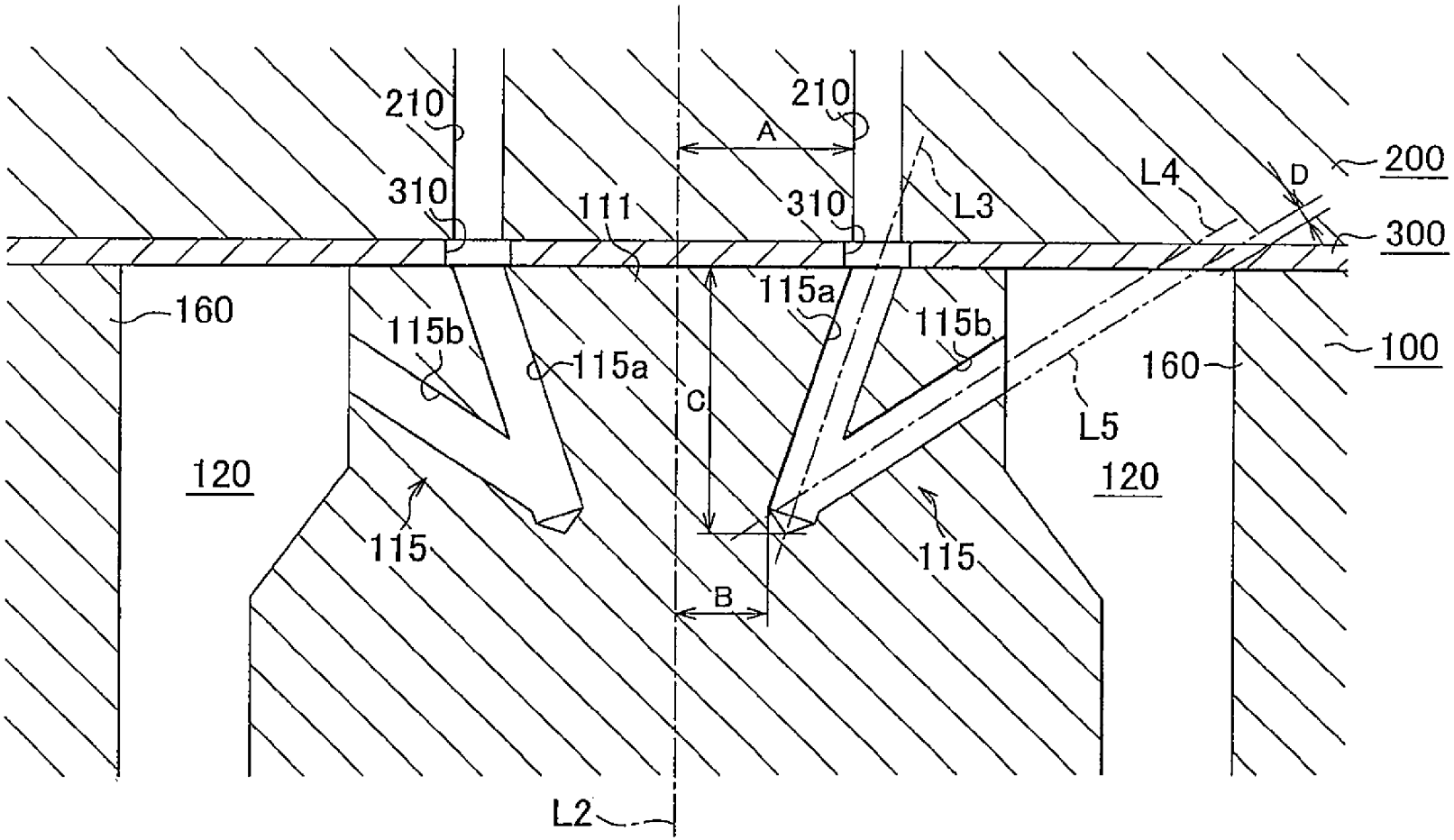
FIG. 3 is a sectional view of an inter-bore partition wall portion of the cylinder block according to the example embodiment.

As shown in FIGS. 2 and 3, the coolant passage 115 is formed by a head-side drill hole 115*a* that opens to the top surface of the inter-bore partition wall 111, and a jacket-side drill hole 115*b* that opens into the water jacket 120. The coolant passage 115 is bent inside the inter-bore partition wall 111 to connect the top surface of the cylinder block 100 with the water jacket 120.

FIG. 3 is a sectional view in the direction along line X-X in FIG. 2. Also, FIG. 3 shows the cylinder block 100 with the cylinder head 200 mounted to it. As shown in FIG. 3, when the cylinder head 200 is mounted to the cylinder block 100, a head gasket 300 is sandwiched between the top surface of the cylinder block 100 and the bottom surface of the cylinder head 200. A water jacket, not shown, is also formed inside the cylinder head 200, and a head-side coolant passage 210 that guides coolant to the water jacket on the cylinder head 200 side is formed in the cylinder head 200. An opening of the head-side drill hole 115*a* is designed to be communicated with this head-side coolant passage 210, and a communicating hole 310 is formed in the head gasket 300, in a position corresponding to a connecting portion of the head-side coolant passage 210 and the head-side drill hole 115*a*.

As a result, as shown in FIG. 3, with the cylinder head 200 mounted, the coolant passage 115 serves as a passage for guiding coolant inside the water jacket 120 to the cylinder head 200 side.

As shown in FIGS. 2 and 3, the opening of the head-side drill hole 115*a* is separated from the center portion of the inter-bore partition wall 111 by a distance A. The alternate long and short dash line L2 in FIG. 3 indicates the direction in which the axis of the cylinder bore 110 extends, and shows the position of the center portion that is the thinnest portion of the inter-bore partition wall 111.

This distance A is set such that the opening of the head-side drill hole 115*a* is separated from the cylinder bore 110 by a distance E. This distance E is set to be greater than the width of a seal portion, not shown, of a peripheral edge portion of the cylinder bore 110 of the head gasket 300. That is, the distance E is a length where the distance between the opening of the head-side drill hole 115*a* and the cylinder bore 110 is shortest.

When the cylinder head 200 is mounted to the cylinder block 100, a seal portion such as a bead formed on the head gasket 300 abuts against the peripheral edge portion of the cylinder bore 110 of the top surface of the cylinder block 100, and the contact pressure therefrom provides a seal against combustion gases.

Here, when the opening of the head-side drill hole 115*a* formed in the top surface of the inter-bore partition wall 111 is formed in a position overlapping the seal portion of the head gasket 300, the area of the seal surface is reduced by the amount of the portion that overlaps with the opening of the head-side drill hole 115*a*, so a suitable seal may not be able to be ensured.

Therefore, with the cylinder block 100 according to this example embodiment, the opening of the head-side drill hole 115*a* in the top surface of the inter-bore partition wall 111 is distanced from the center portion of the top surface of the inter-bore partition wall 111 by a distance A, as shown in FIG. 2. Setting the opening to a position away from the center portion by the distance A in this way ensures the distance E from the cylinder bore 110 to the opening of the head-side drill hole 115*a*, so the opening of the head-side drill hole 115*a* will not overlap with the seal portion of the head gasket 300.

The head-side drill hole 115*a* is such that the direction in which it extends (i.e., the extending direction thereof) is inclined with respect to the axial direction of the cylinder bore 110 (i.e., the alternate long and short dash line L2). More specifically, the head-side drill hole 115*a* is inclined so as to come closer to the center portion indicated by the alternate long and short dash line L2 farther away from the top surface of the inter-bore partition wall 111, i.e., farther down in FIG. 3. Also, the head-side drill hole 115*a* extends to a position where the distance from the tip end portion thereof to the center portion of the inter-bore partition wall 111 is a distance B. This distance B is set such that the coolant passage 115 will not interfere with the cylinder liner 112 shown by the broken line in FIG. 2, so the strength of the inter-bore partition wall 111 can be ensured. The cylinder liner 112 is a cylindrical member that is cast when the main body of the cylinder block 100 is cast, and forms an inner peripheral surface of the cylinder bore 110.

In this way, the jacket-side drill hole 115*b* that extends from the water jacket 120 side is communicated with the tip end portion of the head-side drill hole 115*a* that extends at an angle from the top surface of the inter-bore partition wall 111. With the jacket-side drill hole 115*b* as well, the extending direction thereof is inclined with respect to the axial direction of the cylinder bore 110 (i.e., the alternate long and short dash line L2), as indicated by the alternate long and short dash line L4 in FIG. 3. More specifically, the jacket-side drill hole 115*b* is inclined upward from the portion that is communicated with the head-side drill hole 115*a* toward the opening on the water jacket 120 side so as to gradually come closer to the top surface of the inter-bore partition wall 111.

The inclination of the jacket-side drill hole 115*b* that is inclined in this way is set such that the extended line of the jacket-side drill hole 115*b* that extends to outside of the water jacket 120, as shown by the chain double-dashed line L5 in FIG. 3, does not contact a head bolt boss 160 that forms an outer peripheral side end portion of the water jacket 120. That is, the inclination in the extending direction of the jacket-side drill hole 115*b* is set such that a somewhat large clearance D is able to be ensured between the extended line of the jacket-side drill hole 115*b* and the head bolt boss 160, as shown in FIG. 3.

This clearance D is set to a size that enables the jacket-side drill hole 115*b* to be bored without the drill interfering with the head bolt boss 160, by having the drill enter at angle from the opening of the water jacket 120 when forming the jacket-side drill hole 115*b*.

In this way, with the cylinder block 100 in this example embodiment, the extending directions of the head-side drill hole 115*a* and the jacket-side drill hole 115*b* are inclined with respect to the extending direction of the axis of the cylinder bore 110, so the coolant passage 115 is shaped bent at a sharp (acute) angle, as shown in FIG. 3.

Also, as shown in FIG. 3, the depth C of the portion where the head-side drill hole 115*a* and the jacket-side drill hole 115*b* of the coolant passage 115 are connected is set to match the height where a top ring that is fitted to a piston that is inserted into the cylinder bore 110 is positioned when the piston is at top dead center (TDC).

The coolant passage 115 designed as described above is formed by drilling. More specifically, the head-side drill hole 115*a* is bored by inserting a drill (i.e., drilling) at an angle from the top surface of the inter-bore partition wall 111, while the jacket-side drill hole 115*b* is bored by drilling at an angle toward the center portion side of the inter-bore partition wall 111 from the opening of the water jacket 120 as described above. As a result, the head-side drill hole 115*a* and the jacket-side drill hole 115*b* that have been bored by drilling in this way become communicated with each other inside the inter-bore partition wall 111, thereby forming the coolant passage 115 that communicates the water jacket 120 with the head-side coolant passage 210 of the cylinder head 200, as shown in FIG. 3.

Hereinafter, the operation of the coolant passage 115 in the cylinder block 100 of the example embodiment formed as described above will be described.

The coolant passage 115 is open to the water jacket 120 and the top surface of the inter-bore partition wall 111 that is connected to the cylinder head 200, so coolant that has circulated through the water jacket 120 flows into the head-side coolant passage 210 of the cylinder head 200 through this coolant passage 115. That is, this coolant passage 115 functions as a passage for circulating coolant between the water jacket on the cylinder head 200 side and the water jacket 120 that is formed inside the cylinder block 100.

Also, a flow corresponding to the pressure difference between the coolant inside the water jacket on the cylinder head 200 side and the coolant inside the water jacket 120 on the cylinder block 100 side is generated in the coolant inside of the coolant passage 115, so the coolant inside of the coolant passage 115 circulates quickly.

The coolant passage 115 is bent at a sharp (acute) angle inside the inter-bore partition wall 111 such that the angle created between the head-side drill hole 115*a* and the jacket-side drill hole 115*b* is small. Therefore, the direction of the coolant that flows through the coolant passage 115 changes greatly at the portion where the head-side drill hole 115*a* is connected to the jacket-side drill hole 115*b*. Accordingly, coolant strikes the wall surface of the coolant passage 115 at this portion hard, creating turbulence. As a result, the coolant flowing through the center of the coolant passage 115 and the coolant flowing near the wall surface of the coolant passage 115 are intensely agitated inside the coolant passage 115.

In this way, the upper portion of the inter-bore partition wall 111 that tends to rise in temperature due to the effect of combustion heat is cooled by the coolant circulating through this coolant passage 115 formed inside the inter-bore partition wall 111.

The effects described below are able to be obtained by the example embodiment described above.

(1) The jacket-side drill hole 115*b* is able to be formed by inserting a drill from the opening of the water jacket 120 of the upper portion of the cylinder block 100, which obviates the need for the process to block off an unwanted through-hole after machining a typical cylinder block that involves forming a lower passage through the water jacket from the crankcase side. That is, the coolant passage 115 can be formed without requiring the process of blocking off an unwanted through-hole after machining.

(2) A flow corresponding to the pressure difference between the coolant inside the water jacket on the cylinder head 200 side and the coolant inside the water jacket 120 on the cylinder block 100 side is generated in the coolant inside of the coolant passage 115, so the coolant inside of the coolant passage 115 circulates quickly. Accordingly, a greater cooling effect than that of a typical water jacket that circulates coolant using natural convention is able to be obtained.

(3) A portion near the top surface of the cylinder block 100 that is connected to the cylinder head 200, in particular, the portion from the top surface of the inter-bore partition wall 111 to the height of the top ring when the piston is at TDC, is exposed to high-temperature, high-pressure combustion gases while the engine is operating. Therefore, this portion in particular must be intensively cooled.

Hence, in order to intensively cool this portion, the depth of the lower end portion of the coolant passage 115 may be set based on the height of the top ring when the piston is at TDC.

The coolant passage 115 of the cylinder block 100 is such that the portion where the head-side drill hole 115*a* is connected to the jacket-side drill hole 115*b* is a portion that is farthest away from the top surface of the inter-bore partition wall 111, i.e., is the lower end portion of the coolant passage 115. Regarding this, in the cylinder block 100 in the example embodiment described above, the depth C of the lower end portion of this coolant passage 115 matches the height of the top ring when the piston is at TDC. As a result, coolant is able to be intensively circulated to the portion that is higher than the height of the top ring while circulating as little coolant as possible to the portion lower than the position of the height of the top ring when the piston is at TDC. Therefore, coolant is inhibited from being circulated in an area wider than necessary, and thus is inhibited from increasing in temperature, so the portion from the top surface of the inter-bore partition wall 111 to the height of the top ring when the piston is at TDC that needs to be intensively cooled is able to be efficiently cooled.

(4) If the coolant passage 115 is too close to the center portion that is the thinnest portion of the inter-bore partition wall 111, the strength of the inter-bore partition wall 111 is unable to be ensured. Therefore, with the cylinder block 100 of this example embodiment, the distance B between the center portion and the portion of the coolant passage 115 nearest the center portion is set such that the coolant passage 115 does not reach the cylinder liner 112.

Therefore, the coolant passage 115 is inhibited from interfering with the cylinder liner 112, and the strength of the inter-bore partition wall 111 can be ensured by appropriately distancing the coolant passage 115 from the center portion.

(5) The distance A between the opening of the head-side drill hole 115*a* in the top surface of the inter-bore partition wall 111 and the center portion of the top surface of the inter-bore partition wall 111 is set such that the opening does not overlap with the seal portion of the head gasket 300. Accordingly, the position of the opening is appropriately distanced from the seal portion, which inhibits the area of the seal surface of the head gasket 300 from decreasing, and thus enables a sufficient seal to be ensured.

(6) If the angle formed by the head-side drill hole 115*a* and the jacket-side drill hole 115*b* that intersect inside the inter-bore partition wall 111 and together form the coolant passage 115 is reduced, the direction of the coolant that flows through the coolant passage 115 greatly changes at the portion where the head-side drill hole 115*a* connects with the jacket-side drill hole 115*b*. Therefore, coolant strikes the wall surface of the coolant passage 115 at this portion hard, creating turbulence. As a result, the coolant flowing through the center of the coolant passage 115 and the coolant flowing near the wall surface of the coolant passage 115 are agitated, such that the effect of heat exchange performed via the wall surface of the coolant passage 115 further increases.

Regarding this, with the cylinder block 100 of the example embodiment described above, the angle formed by the head-side drill hole 115*a* and the jacket-side drill hole 115*b* is an acute (i.e., a sharp) angle, so coolant strikes the wall surface of the coolant passage 115 hard at the portion where the head-side drill hole 115*a* connects with the jacket-side drill hole 115*b*. Accordingly, turbulence is generated inside the coolant passage 115, so the heat exchange efficiency is increased.

(7) Two coolant passages 115 are formed inside the inter-bore partition wall 111, and the two coolant passages 115 are provided sandwiching the center portion of the inter-bore partition wall 111. As a result, the cooling effect is greater than it is with a structure in which only one coolant passage 115 is provided. Also, both of the portions on both sides of the center portion of the inter-bore partition wall 111 are cooled, so the entire inter-bore partition wall 111 is able to be cooled more evenly.

The example embodiment described above may also be suitably modified as described below.

In the example embodiment described above, a structure is described in which the depth C of the lower end of the coolant passage 115 is set such that the position of the lower end of the coolant passage 115 is at a depth equal to the height of the top ring when the piston is at TDC. However, the position of the lower end of the coolant passage 115 does not necessarily have to be at a depth equal to the height of the top ring.

That is, coolant can be more intensively circulated to those portions in particular that require cooling, by positioning the lower end of the coolant passage 115 closer to the height of the top ring when the piston is at TDC. However, the upper portion of the inter-bore partition wall 111 is able to be cooled even if the position of the lower end of the coolant passage 115 is offset from the height of the top ring, so the position of the lower end of the coolant passage 115 does not necessarily have to be equal to the height of the top ring.

In the example embodiment described above, an example in which the invention is the cylinder block 100 of an inline four cylinder engine is described. However, the invention may be applied not only to an inline four cylinder engine, but also to an engine with another cylinder layout, such as a V-type six cylinder (V-6) engine or a V-type eight cylinder (V-8) engine or the like. In this case, the coolant passage 115 need simply be provided, similar to this example embodiment, in the inter-bore partition walls in each cylinder back.

In the example embodiment described above, a structure is described in which two coolant passages 115 are provided, one on each side of (i.e., sandwiching) the center portion of the inter-bore partition wall 111. However, a structure in which one coolant passage 115 is formed in only one of the portions sandwiching the center portion of the inter-bore partition wall 111 may also be employed.

Also, a structure in which three or more coolant passages 115 are provided may also be employed.

Furthermore, the way in which the coolant passages 115 are arranged in the inter-bore partition walls 111 may be different. For example, a structure in which the coolant passages 115 are not provided in some of the inter-bore partition walls 111, or a structure in which the number of coolant passages 115 provided in each inter-bore partition wall 111 differs appropriately, may be employed.

In the example embodiment described above, the coolant passage 115 is formed by a drill hole, but the coolant passage 115 is not limited to being a hole formed by a drill. In this case, the head-side drill hole 115*a* and the jacket-side drill hole 115*b* may not be holes that are in straight lines.

The invention claimed is:

1. A cylinder block comprising:

a plurality of cylinder bores;

a water jacket surrounding the plurality of cylinder bores;

an inter-bore partition wall being positioned between adjacent cylinder bores;

a coolant passage, disposed inside the inter-bore partition wall, for guiding coolant from the water jacket without passing through a center portion that is a thinnest portion of the inter-bore partition wall, the coolant passage having i) a head-side hole that opens at a position away from the center portion of a top surface on a cylinder head side of the inter-bore partition wall and is formed inclined with respect to an axial direction of the cylinder bore so as to come closer to the center portion farther away from the top surface, and having ii) a jacket-side hole that is communicated with a tip end portion of the head-side hole and opens into the water jacket and is formed inclined with respect to the axial direction from a portion that is communicated with the head-side hole toward the opening so as to gradually come closer to the top surface, wherein an extension line of the jacket-side hole that extends to outside of the water jacket is set such that the extension line does not contact a head bolt boss that forms an outer peripheral side end portion of the water jacket.

2. The cylinder block according to claim 1, wherein a depth, in the axial direction from the top surface of the inter-bore partition wall, of a portion where the head-side hole is communicated with the jacket-side hole is set based on a height of a top ring when a piston is at top dead center.

3. The cylinder block according to claim 1, wherein the tip end portion of the head-side hole is located such that the tip end portion of the head-side hole does not interfere with a cylinder liner that forms an inner peripheral surface of the cylinder bore.

4. The cylinder block according to claim 1, wherein a shortest length between an opening of the head-side hole in the top surface of the inter-bore partition wall and the cylinder bore is set such that the opening does not overlap with a seal portion of a cylinder bore peripheral edge of a head gasket.

5. The cylinder block according to claim 1, wherein an angle between the head-side hole and the jacket-side hole is an acute angle.

6. The cylinder block according to claim 1, wherein a pair of the coolant passages is formed in the inter-bore partition wall so as to sandwich the center portion of the inter-bore partition wall.

7. The cylinder block according to claim 6, wherein the two coolant passages are provided axisymmetrical about the center portion inside the inter-bore partition wall.

8. The cylinder block according to claim 1, wherein the head-side hole and the jacket-side hole are both holes that are in straight lines.

9. A manufacturing method of a cylinder block provided with a water jacket formed surrounding a plurality of cylinder bores, and a coolant passage that is inside of an inter-bore partition wall positioned between adjacent cylinder bores and that guides coolant inside of the water jacket without passing through a center portion that is a thinnest portion of the inter-bore partition wall, the method comprising:

drilling a head-side hole, in the inter-bore partition wall, at an angle inclined with respect to an axial direction of the cylinder bore so as to come closer to the center portion farther away from a top surface on a cylinder head side of the inter-bore partition wall, from a position away from the center portion of the top surface; and drilling a jacket-side hole, in the inter-bore partition wall, at an angle inclined with respect to the axial direction from a wall surface of the inter-bore partition wall that faces the water jacket toward a tip end of the head-side hole so as to gradually come closer to the top surface, and communicating the head-side hole with the jacket-side hole, wherein an extension line of the jacket-side hole that extends to outside of the water jacket is set such that the extension line does not contact a head bolt boss that forms an outer peripheral side end portion of the water jacket.

* * * * *